US011015325B2

(12) United States Patent
Bares et al.

(10) Patent No.: US 11,015,325 B2
(45) Date of Patent: May 25, 2021

(54) BRIDGE-STYLE FAUCET FOR SINGLE-HOLE INSTALLATION

(71) Applicant: Kohler Co., Kohler, WI (US)

(72) Inventors: William Robert Bares, Fredonia, WI (US); Jacob R. Frye, Sheboygan Falls, WI (US); Brian J. Mooren, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 26 days.

(21) Appl. No.: 16/428,533

(22) Filed: May 31, 2019

(65) Prior Publication Data

US 2020/0378096 A1 Dec. 3, 2020

(51) Int. Cl.
*E03C 1/04* (2006.01)

(52) U.S. Cl.
CPC ..... *E03C 1/04* (2013.01); *E03C 2001/0415* (2013.01)

(58) Field of Classification Search
CPC ..... E03C 1/04; E03C 1/0401; E03C 1/0404; E03C 2001/0415; F16K 19/006
USPC ..... 137/603, 801; 4/678, 695
See application file for complete search history.

(56) References Cited

U.S. PATENT DOCUMENTS

| | | | | |
|---|---|---|---|---|
| 5,996,614 | A | 12/1999 | Ashton | |
| 2006/0266424 | A1 | 11/2006 | Filtness | |
| 2012/0018020 | A1* | 1/2012 | Moore | E03C 1/0403 137/798 |
| 2018/0353376 | A1 | 12/2018 | Perrin et al. | |

FOREIGN PATENT DOCUMENTS

| | | |
|---|---|---|
| EP | 1479835 | 11/2004 |

* cited by examiner

*Primary Examiner* — Paul J Gray
(74) *Attorney, Agent, or Firm* — Foley & Lardner LLP

(57) ABSTRACT

A faucet configured for single-hole installation includes a center body within which a connector body defining hot and cold water inlets and an outlet is supported. A pair of side bodies are attached to the center body about opposite sides of the center body. Bridges including flow paths extend between and connect each side body to the center body. A valve supported within the first side body fluidly couples the hot water inlet with the outlet via the flow path of the first bridge responsive to rotation of a handle supported by the first side body. A valve supported within the second side body fluidly couples the cold water inlet with the outlet via the flow path of the second bridge responsive to rotation of a handle supported by the second side body.

20 Claims, 10 Drawing Sheets

BRIDGE-STYLE FAUCET FOR SINGLE-HOLE INSTALLATION

BACKGROUND

The present disclosure generally relates to bridge style faucets (e.g., kitchen faucets). More specifically, this application relates to bridge style faucets having a widespread configuration that are mountable to both widespread and center-set faucet mounting configurations.

Despite the ease and freedom of installation provided by single-hole faucets (e.g., center-set faucets), conventional single-hole faucets define a limited selection of faucet configurations. In particular, the arrangements of conventional single-hole faucets are limited to designs and configurations in which handles of the faucet are attached to and supported by the exterior of a single or central body of the faucet, and extend outwards relative to the central body directly from the exterior of the central body. As the handles in such conventional single-hole faucets are supported by the central body, the footprint defined by such conventional single-hole faucets is generally limited to the footprint defined by a lower surface of the single or central body.

Conventional widespread faucets (or other conventional faucets configured to three-hole mounting) provide a selection of various configurations that define footprints that are different (e.g., larger) than those defined by conventional single-hole faucets. One example of such a large footprint faucet configuration is a bridge-type faucet arrangement comprising a center housing structure and a pair of side housing structures connected to the center housing structure via a pair of bridges, where the base portions of the side housing structures and the center housing structure are mounted separately and spaced apart from one another. However, given the three-hole mounting requirements of conventional widespread faucets, such conventional widespread faucets may be a viable option only when the faucet is used with a support structure specifically designed to accept such a faucet, such as where hot water is routed through the mounting surface of one of the side housing structures and the cold water is routed through the mounting surface of the other of the side housing structures.

SUMMARY

According to at least one implementation of the present disclosure, a faucet (e.g., a widespread bridge style faucet) includes a center body having a sidewall that extends about and defines an internal passageway and a support surface on an end of the sidewall. The center body has a cold water inlet in the internal passageway, a hot water inlet in the internal passageway, and an outlet. A spout is coupled to the center body and is fluidly connected to the outlet.

A first side body is offset from the center body in a first direction. The first side body has a sidewall extending about and defining a bore and a support surface. A second side body is offset from the center body in a second direction. The second side body has a sidewall extending about and defining a bore and a support surface. A first valve is located in the bore of the first side body. A second valve is located in the bore of the second side body.

A first bridge interconnects the center body and the first side body. The first bridge includes a first fluid passage, which fluidly connects the cold water inlet to an inlet of the first valve, and a second fluid passage, which fluidly connects an outlet of the first valve to the outlet of the center body. A second bridge interconnects the center body and the second side body, the second bridge includes a first fluid passage, which fluidly connects the hot water inlet to an inlet of the second valve, and a second fluid passage, which fluidly connects an outlet of the second valve to the outlet of the center body.

In one or more exemplary embodiments, the support surfaces of each of the first side body, second side body and center body extend along parallel planes. In one or more exemplary embodiments, the support surfaces of each of the center body, the first side body, and the second side body are coplanar. In one or more exemplary embodiments, the support surface of at least one of the center body, first side body, or second side body is spaced apart and separated from at least one of the other support surfaces in a longitudinal direction of the center body. In one or more exemplary embodiments, a first gasket is provided within an inner periphery defined by the support surface of the first side body, a second gasket is provided within an inner periphery defined by the support surface of the second side body, and a third gasket is provided within an inner periphery defined by the support surface of the center body. The first gasket extends downwards relative to the support surface of the first side body by a first distance, the second gasket extends downwards relative to the support surface of the second side body by the first distance, and the third gasket extends downwards relative to the support surface of the center body by a second distance, where the first distance is less than the second distance.

In one or more exemplary embodiments, the first bridge includes a first end that extends through a first opening in the sidewall of the center body to connect the first end of the first bridge to the center body. A second end of the first bridge extends through an opening in the sidewall of the first side body to connect the second end of the first bridge to the first side body. The second bridge includes a first end that extends through a second opening in the sidewall of the center body to connect the first end of the second bridge to the center body. A second end of the second bridge extends through an opening in the sidewall of the second side body to connect the second end of the second bridge to the second side body.

In one or more exemplary embodiments, the first opening and the second opening of the center body are located on opposite sides of the center body, such that the first bridge and second bridge extend outwardly away from the sidewall of the center body in opposite directions. In one or more exemplary embodiments, each of the first bridge and the second bridge extends in a transverse direction relative to a longitudinal axis of the center body.

According to at least one implementation of the present disclosure, a faucet includes a center post having a sidewall defining an internal cavity. A connector body is disposed in the internal cavity and defines a cold water inlet, a hot water inlet, and an outlet. A first side post is coupled to an exterior surface of the sidewall. The first side post is configured to house a first valve, which is configured to selectively fluidly couple an inlet cold water flow path, which is fluidly connected to the cold water inlet, with an outlet cold water flow path, which is fluidly connected to the outlet of the connector body. A second side post is coupled to the exterior surface of the sidewall. The second side post is configured to house a second valve, which is configured to selectively fluidly couple an inlet hot water flow path, which is fluidly connected to the hot water inlet, with an outlet hot water flow path, which is fluidly connected to the outlet of the connector body. Lower portions of each of the sidewall defining the center post, the first side post and the second side post define substantially coplanar or substantially parallel support surfaces.

In some exemplary embodiments, each side post has a longitudinal axis that is offset from a longitudinal axis of the center post by a distance of at least 4 inches.

In one or more exemplary embodiments, a first fluid coupling connects a cold water supply source to the cold water inlet and a second fluid coupling connects a hot water supply source to the hot water inlet. Each of the first fluid coupling and the second fluid coupling extends through a portion of the internal cavity defined by the sidewall of the center post.

In one or more exemplary embodiments, each of the inlet and outlet cold water flow paths extends through each of a first opening in the sidewall of the center post and an opening in the first side post that is spaced apart and longitudinally offset from the first opening in the center post sidewall such that a portion of each of the inlet and outlet cold water flow paths extends externally relative to each of the center post sidewall and the first side post. Each of the hot water flow paths extends through each of a second opening in the sidewall of the center post and an opening in the second side post that is spaced apart and longitudinally offset from the second opening in the center post sidewall such that a portion of each of the inlet and outlet hot water flow paths extends externally relative to each of the center post and the second side post sidewall.

In one or more exemplary embodiments, a first bridge is disposed between and interconnects the first side post and the sidewall of the center post. A second bridge is disposed between and interconnects the second side post and the sidewall of the center post.

In one or more exemplary embodiments, the first bridge includes an attachment housing having an interior within which a body defining a portion of the cold water flow path is supported. The second bridge includes an attachment housing having an interior within which a body defining a portion of the hot water flow path is supported.

In one or more exemplary embodiments, a portion of the body supported within the first bridge extends within an interior of the first side post and a portion of the body supported within the second bridge extends within an interior of the second side post.

In one or more exemplary embodiments, a first valve is positioned in an opening defined by the portion of the body supported within the first bridge that extends within the first side post interior and a second valve is positioned in an opening defined by the portion of the body supported within the second bridge that extends within the second side post interior.

According to at least one implementation of the present disclosure, a faucet includes a center body extending along a longitudinal axis between a lower end defining a support surface and an upper portion. A first side body extends along a longitudinal axis that is offset from the longitudinal axis of the center body. The first side body has a lower end that defines a support surface. A second side body extends along a longitudinal axis that is offset from the longitudinal axis of the center body. The second side body has a lower end that defines a support surface.

A center waterway body is disposed within the center body and includes first and second hot water inlets, a hot water outlet fluidly coupled to the first hot water inlet, first and second cold water inlets, a cold water outlet fluidly coupled to the first cold water inlet, and an outlet fluidly coupled to the second hot water inlet and the second cold water inlet. A first waterway body interconnects the first side body and the center body. The first waterway body defines an inlet flow path, which fluidly connects the hot water outlet to an inlet of the first side body, and an outlet flow path, which fluidly connects an outlet of the first side body to the second hot water inlet. A second waterway body interconnects the second side body and the center body. The second waterway body defines an inlet flow path, which fluidly connects the cold water outlet to the inlet of the second side body, and an outlet flow path, which fluidly connects an outlet of the second side body to the second cold water inlet. The support surface of each side body is spaced apart laterally from the support surface of the center body.

In one or more exemplary embodiments, a first valve is located within a bore of the first side body. The first valve fluidly connects/disconnects the inlet and the outlet of the first side body. A second valve is located within a bore of the second side body. The second valve fluidly connects/disconnects the inlet and the outlet of the second side body.

In one or more exemplary embodiments, a first bridge housing extends between and interconnects the center body and the first side body. The first waterway body is disposed within the first bridge housing. A second bridge housing extends between and interconnects the center body and the second side body. The second waterway body is disposed within the second bridge housing.

In one or more exemplary embodiments, a portion of the first waterway body is supported within the first side body and a portion of the second waterway body is supported within the second side body.

DETAILED DESCRIPTION

Figure 1:
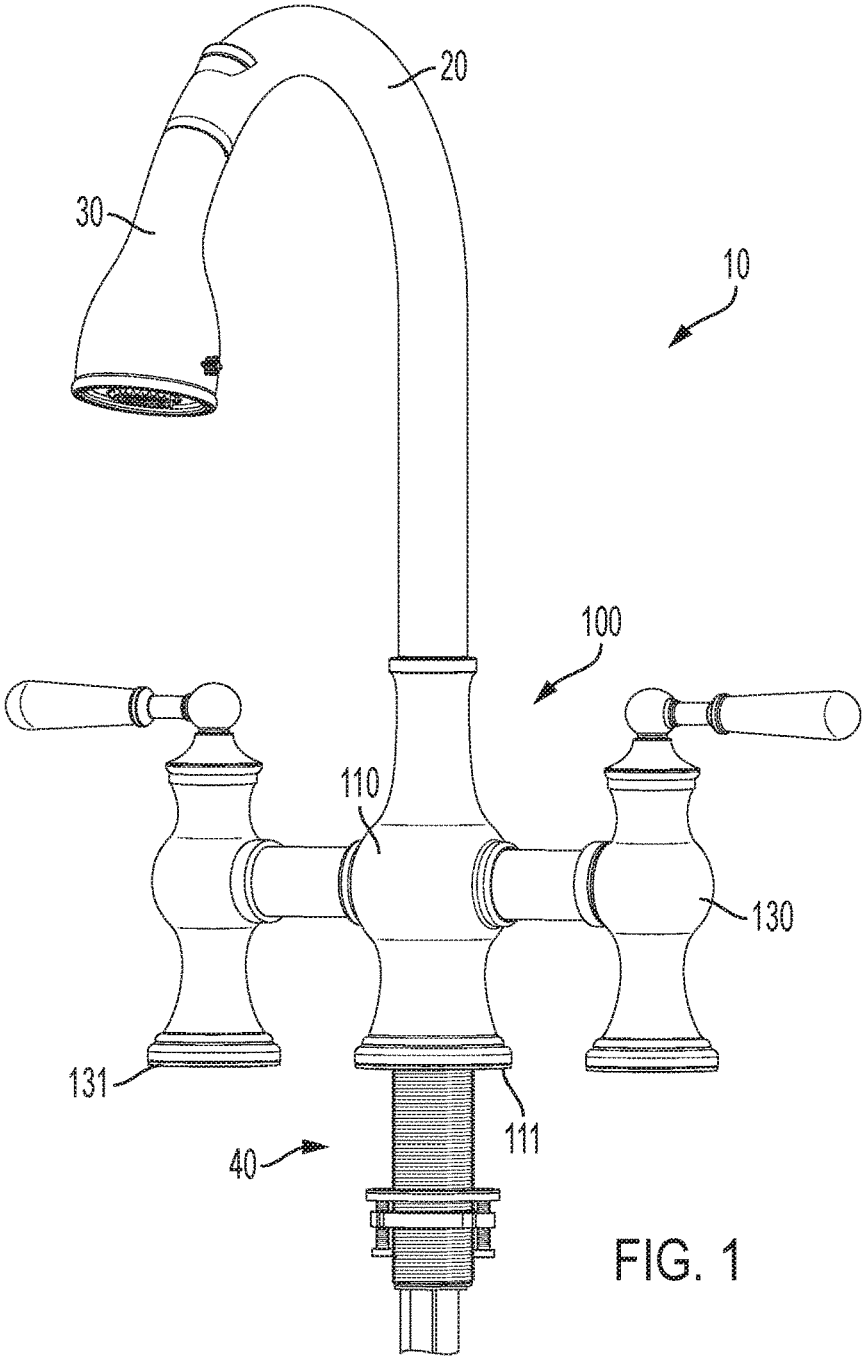
FIG. 1 is a perspective view of an exemplary embodiment of an assembled faucet, according to this application.

Referring generally to the FIGURES, a faucet including a housing assembly and a flow assembly is described and shown according to one or more embodiments. As shown in FIG. 1, and as will be described in more detail below, the various housing assembly and flow assembly configurations and arrangements described herein are configured to advantageously allow the faucet 10 to incorporate various design features associated with widespread faucets (or other faucets requiring three-hole mounting) such as, e.g., a large mounting footprint; a faucet arrangement having handles that are mounted separately from and are longitudinally offset from a center body of the faucet, etc., with the convenience and universality associated with a single-hole installation faucet. Moreover, the faucets of this application advantageously can replace center-set faucets, since the faucets can mount to a single hole as used by center-set faucets. In this way, a home owner does not have to replace the sink, deck, or other mounting structure if they want to replace a center-set faucet with a faucet having a widespread look, such as the bridge style faucets disclosed herein.

Figure 2:
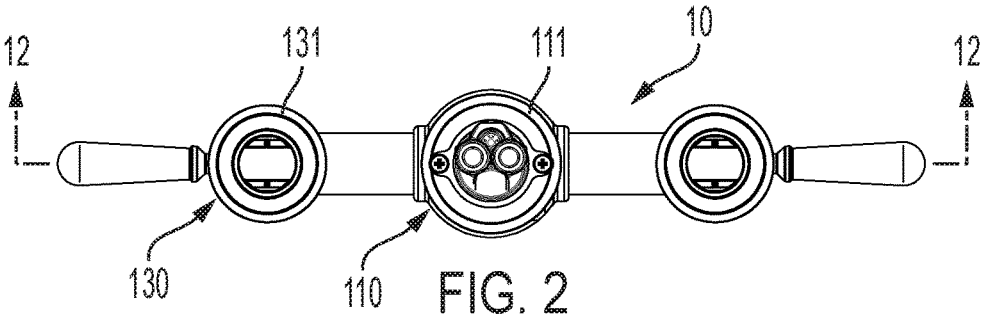
FIG. 2 is a bottom view of the faucet shown in FIG. 1.

FIG. 1 illustrates an exemplary embodiment of the faucet 10 that includes a spout 20, a spray head 30, mounting structures 40, and a housing assembly 100. A flow assembly 200 that selectively controls the delivery of hot and/or cold water from a hot water supply and a cold water supply to the spout 20, and the spray head 30 supported by the spout 20, is supported within the housing assembly 100. The mounting structures 40 secure the housing assembly 100 in place, such as to a sink (e.g., deck), countertop or other suitable support structure. The spout 20 extends from the housing assembly 100 and supports the spray head 30, which is configured to dispense or emit water in one or more spray patterns. Despite its widespread, bridge style design, the faucet 10 is configured for single-hole installation. As shown in FIG. 2, neither hot nor cold water from the hot water supply and cold water supply is routed through the mounting surfaces (i.e. lower surfaces 131) of the side bodies 130 of the housing assembly 100.

Figure 3:
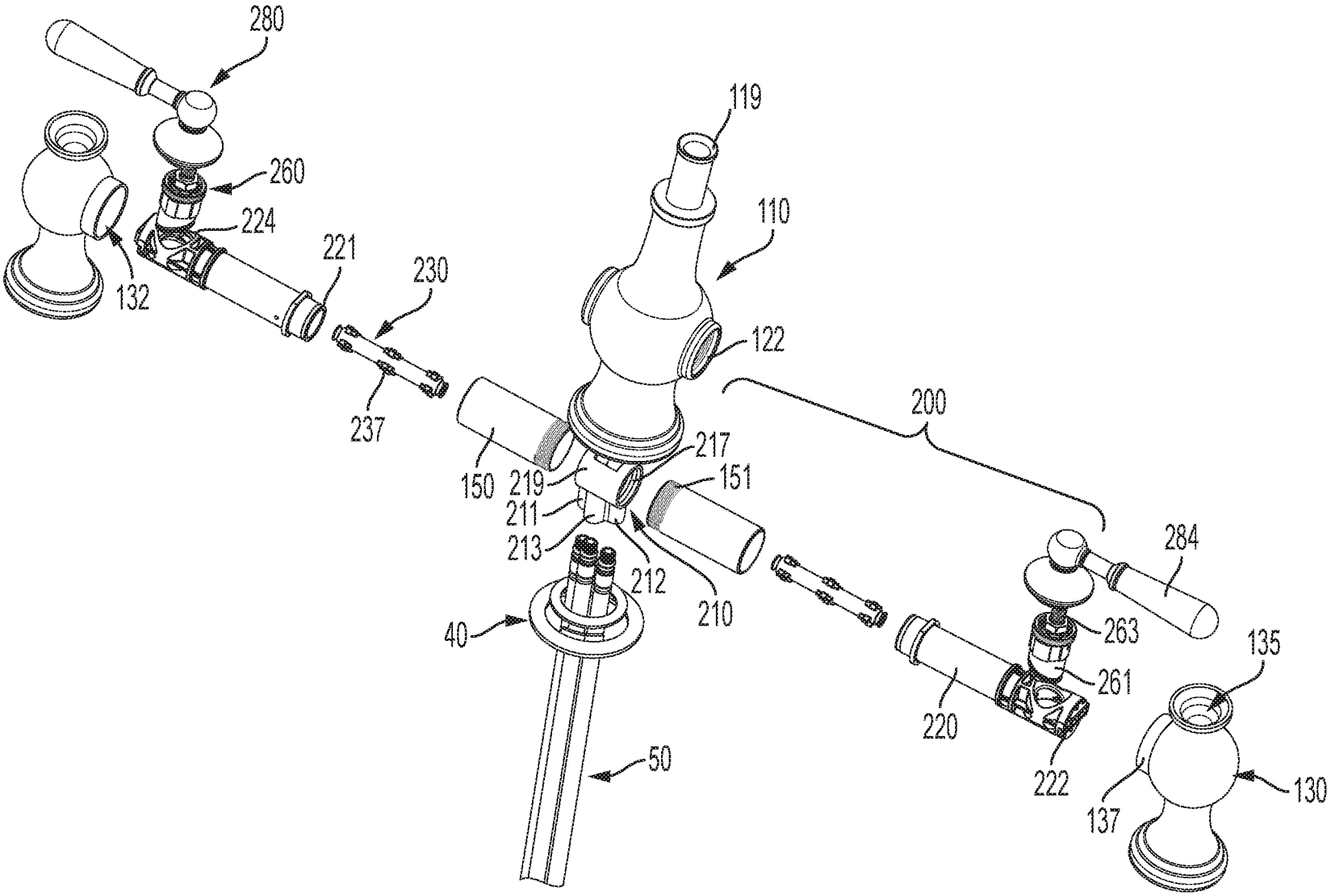
FIG. 3 is an exploded top perspective view of a portion of the faucet shown in FIG. 1.
Figure 4:
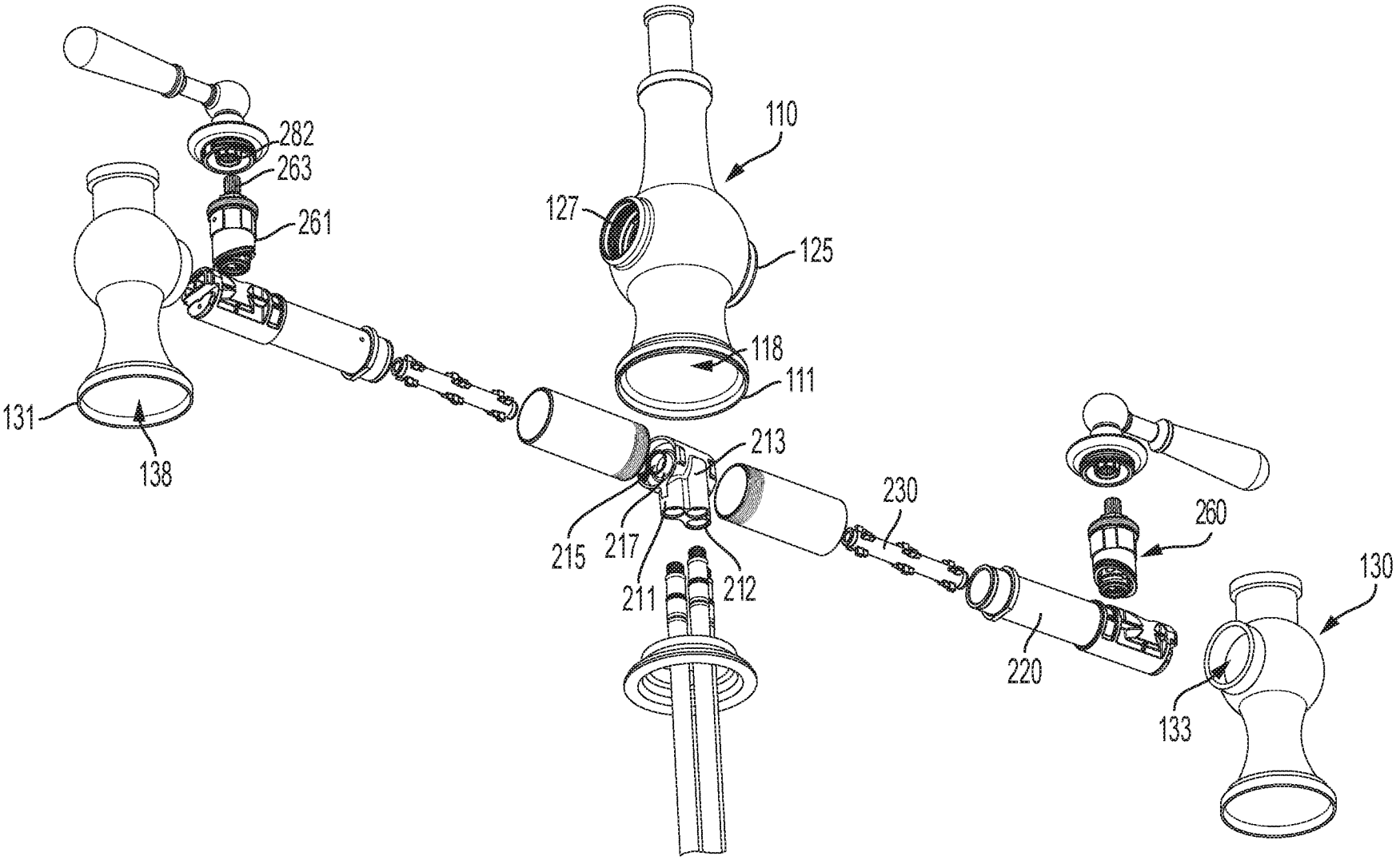
FIG. 4 is an exploded bottom perspective view of the faucet shown in FIG. 3.

FIGS. 3 and 4 show exploded views of the housing assembly 100 and the flow assembly 200 of the faucet 10, according to exemplary embodiments. The various components defining the housing assembly 100 and the flow assembly 200 shown in FIGS. 3 and 4 are described in detail below.

The housing assembly 100 includes a center body 110, a pair of side bodies 130, and a pair of bridges 150. An interior of the housing assembly 100 defines a chamber within which, or relative to which, at least part of (e.g., the entirety) of the flow assembly 200 is supported. The components of the housing assembly 100 also define support surfaces via which the faucet 10 may be coupled (e.g., attached, secured, etc.) relative to a desired support structure.

The lower surfaces 131 of each of the side bodies 130 and the lower surface 111 of the center body 110 (see FIG. 2) are support surfaces. Each illustrated lower surface 131, 111 is defined by a discrete periphery that is spaced apart and/or separated from the other lower surfaces 131, 111, such as in a lateral or vertical direction (relative to the faucet 10 and/or support structure). Each lower surface 131, 111 is configured to contact an upper surface of a support structure (e.g., countertop, a deck plate or other intermediate mount structure, etc.) to secure the faucet 10 in a desired position relative to the support structure.

As shown in FIG. 1, when the faucet 10 is assembled, the lower surfaces 131 of the side bodies 130 and the lower surface 111 of the center body 110 are coplanar, or substantially coplanar (e.g., extend along planes that are within approximately ±0.02 inches of each other, such as offset by this distance vertically). As the faucet 10 is configured to allow for single-hole installation, a pair of (e.g. first and second) side body gaskets 45 may be provided at (e.g., within, about, etc.) the lower surface 131 of each side body 130, and a center body gasket 43 (e.g., third) may be provided at the lower surface 11 of the center body 110 (see FIG. 12). The center body gasket 43 and pair of side body gaskets 45 are configured to assist in securing the side bodies 130 relative to the support structure such that rotation or other movement (e.g. in lateral and/or longitudinal directions) is minimized, or prevented, during use of the faucet 10 by increasing the frictional resistance between the support structure and the lower surfaces 111, 131 of the center body 110 and side bodies 130.

To increase securement of the side bodies 130 relative to the support surface, the side body gaskets 45 in one or more embodiments are formed of a material (e.g., rubber, elastomer, etc.) having a higher durometer valve and a higher frictional coefficient than that of a material (e.g. a foam-like material) used to form the center body gasket 43. In such embodiments, the center body gasket 43 is attached to the center body 110 and the side body gaskets 45 are attached to the side bodies 131 such that a lower portion of the center body gasket 43 is located below (e.g., offset vertically down from) the lower surfaces of the side body gaskets 45. For example, the lower surfaces of the side body gaskets 45 may be vertically offset from the center body gasket 43 by a distance of approximately 0.05 inches±0.02 inches (e.g., from 0.03 to 0.07 inches). Upon installation of the faucet 10, the more compliant and more compressible material forming the center body gasket 43 allows the center body gasket 43 to compress by an amount that is greater than the side body gaskets 45. The lower compressible side body gaskets 45 therefore induce higher longitudinal and frictional forces (relative to the center body gasket 43) during and after installation (e.g., clamping, mounting of the center body post, as described herein) to prevent rotation of the side bodies relative to the longitudinal axis of the center body, such as during use of the faucet. The higher frictional value, lower compliance and lower compressibility of the center body gaskets 45 and the increased compression of the center bodies 130 relative to the support surface provided by such an arrangement increase the threshold force that would be required to rotate or otherwise move the center bodies, thus allowing for a secure attachment of the faucet (e.g., that prohibits movement, such as rotation, of the faucet) relative to the support surface.

Alternatively, in one or more other embodiments, the lower surfaces 131 of the side bodies 130 may be offset above or below (e.g., extend a distance below) the lower surface 111 of the center body 110, such as between approximately 0.03 inches and 0.07 inches. That is, the lower surfaces 131 of the side bodies 130 can be vertically offset from the lower surface 111 of the center body 110, and instead extend along a plane that is parallel, or substantially parallel (e.g., extend along planes that are within approximately 2 degrees of each other) to the plane along which the lower surface 111 of the center post extends 110. This vertical offset may allow the side bodies 130 to press against the support structure and apply a force to the support structure which advantageously prevents, or minimizes, rotation of the side bodies 130 during operation of the faucet 10.

The faucet 10 may also optionally include, or may be configured to be used with, various mounting structures 40 that may facilitate the securement of the faucet 10 at a desired location about a support structure. Such mounting structures 40 may define any number of components or elements that may be used to attach, adhere, mount, or otherwise secure some or all of the side bodies 130 and/or center body 110 to the support structure.

Figure 6:
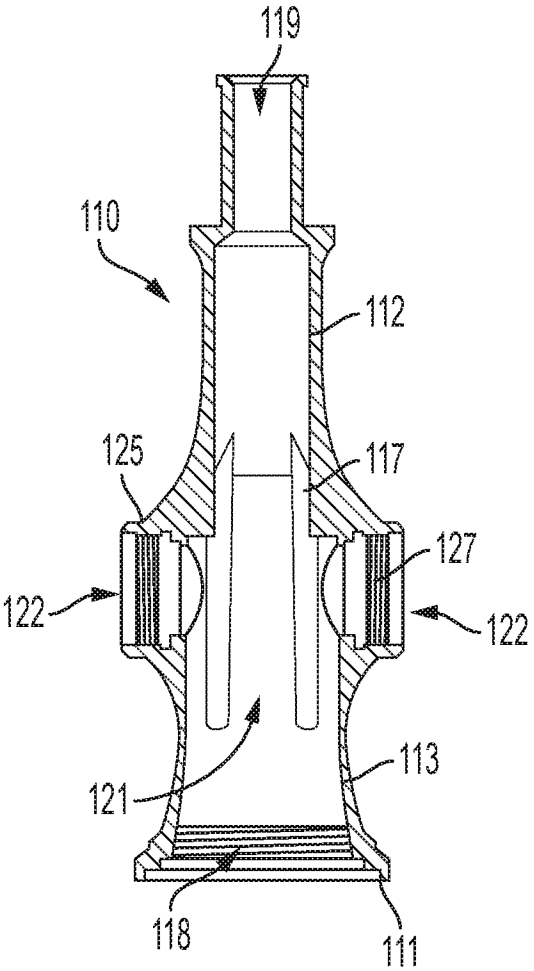
FIG. 6 is a cross-sectional view of the center post shown in FIG. 5.
Figure 5:
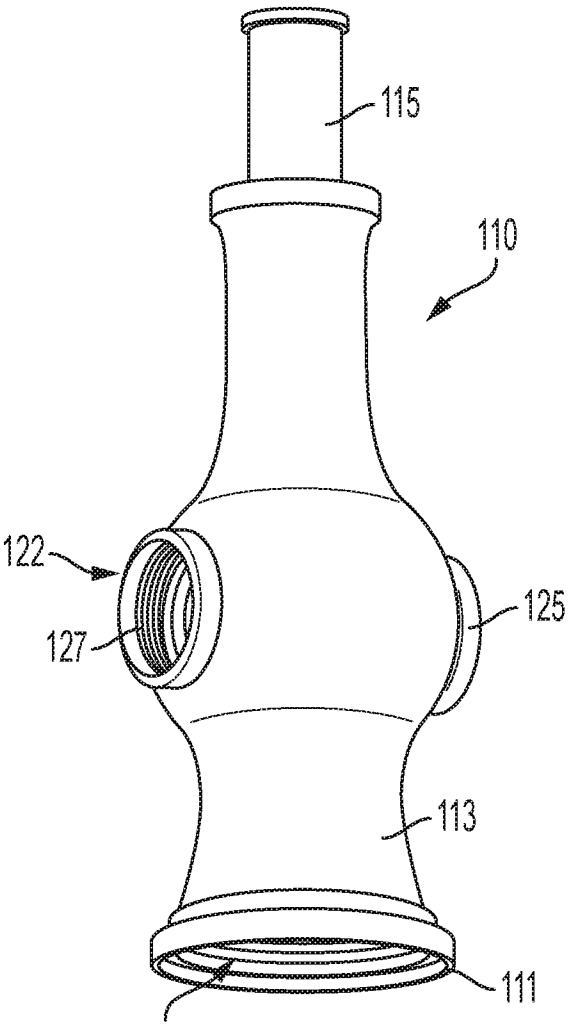
FIG. 5 is a perspective view of a center post, according to an exemplary embodiment.

Referring to FIGS. 5 and 6, the center body 110 of the housing assembly 100 is defined by a hollow post, or other structure defining a hollow interior. A sidewall 112 defines the center body 10 and extends between a lower base portion 113 and an upper neck portion 115. An internal chamber 121 (e.g., cavity, bore, etc.) is defined by the hollow interior of the center body 110 (e.g., the sidewall 112). As shown in FIG. 6, an interior surface of the sidewall 112 may optionally be provided with inwardly extending flanges 117 that aid in aligning and/or preventing rotation of a connector assembly 210 of the flow assembly 200 that is supported (see FIG. 11) within the chamber 121. Alternatively, or additionally, the inner surface of the sidewall 112 may include other structures or elements that assist in supporting the connector assembly 210 in a desired configuration or orientation within the chamber 121.

As shown in FIG. 5, a lower surface 111 of the lower base portion 113 extends about and defines a lower opening 118 of the center body 110. The chamber 121 is fluidly connected to the lower opening 118, thereby allowing fluid tubing 50 (e.g., hot and cold water tubes or lines, mixed water line, etc.) attached to and extending from external hot and cold water supplies to be connected to a first hot water inlet 211 and a first cold water inlet 212 of the connector assembly 210 supported within the chamber 121 (see FIG. 12). The lower opening 118 of the center body 110 (and also optionally the connector assembly 210 supported within the chamber 121) may additionally be sized and shaped to allow additional fluid tubing 50 and/or other elements to be inserted into and/or through the chamber 121 from a location external to the center body 110. For example, the lower opening 118 may optionally be sized to additionally allow a fluid hose of a pull-down spout 20, as well as a fluid tubing 50 connected between an outlet 213 of the connector assembly 210 and an inlet of the fluid hose, to extend therethrough.

The upper neck portion 115 of the center body 110 may include and/or define any number of different structures or configurations via which a separately provided spout 20 may be secured (e.g., rotatably secured) relative to the center body 110. Alternatively, the spout 20 and upper neck portion 115 may be formed and provided as a monolithic, or otherwise integral, single-piece structure. A spout 20 defined by any number of shapes, sizes, configurations, features, etc. may be attached to the housing assembly 100. For example, as representatively illustrated by the faucet 10 shown in FIG. 1 and according to one or more embodiments, the spout 20 may be a goose-necked pull-down design.

An upper opening 119 defined by the upper neck portion 115 allows water from the outlet 213 of the flow assembly 200 to pass through the spout 20 and be dispensed through one or more outlets of the spray head 30. Notably, the manner in which water from the outlet 213 of the flow assembly 200 is dispensed through the upper opening 119 and the outlet of a spout 20 may vary depending on the specific features of the spout 20. Water from the outlet 213 may flow into a waterway inlet of the spout 20 and through an outlet of the spout 20 directly from the outlet 213 (i.e., without passing through fluid tubing or other flow structures). Alternatively, water from the outlet 213 may be fluidly coupled to the spout 20 waterway inlet via some type of fluid tubing that is fluidly coupled to the outlet 213. In some such embodiments, the fluid tubing fluidly coupled to the outlet 213 only delivers water to the spout 20 waterway inlet. The water delivered to the spout 20 waterway inlet then flows directly through the waterway of the spout 20 and through the spout 20 outlet. In other such embodiments, e.g. faucets having a pull-down spout (such as representatively illustrated by the FIGURES), the fluid tubing to which the outlet 213 is fluidly connected extends through the waterway of the spout, such that water flows through the waterway of the spout 20 within the fluid tubing (i.e. flows indirectly through the spout 20).

The center body 110 may include or define additional features or elements from those shown in the FIGURES depending on the type of spout 20 used with the housing assembly 100 and/or whether water from the outlet 213 flows through the upper opening 119 directly from the outlet 213 or indirectly through fluid tubing. The arrangement or configuration of the outlet 213 relative to the remaining components of the center body 100 and features of the connector assembly 210 supported within the center body 100 may also vary depending on the type of spout 20 used with the housing assembly 100 and/or whether water from the outlet 213 flows directly or indirectly through the upper opening 119.

Figure 11:
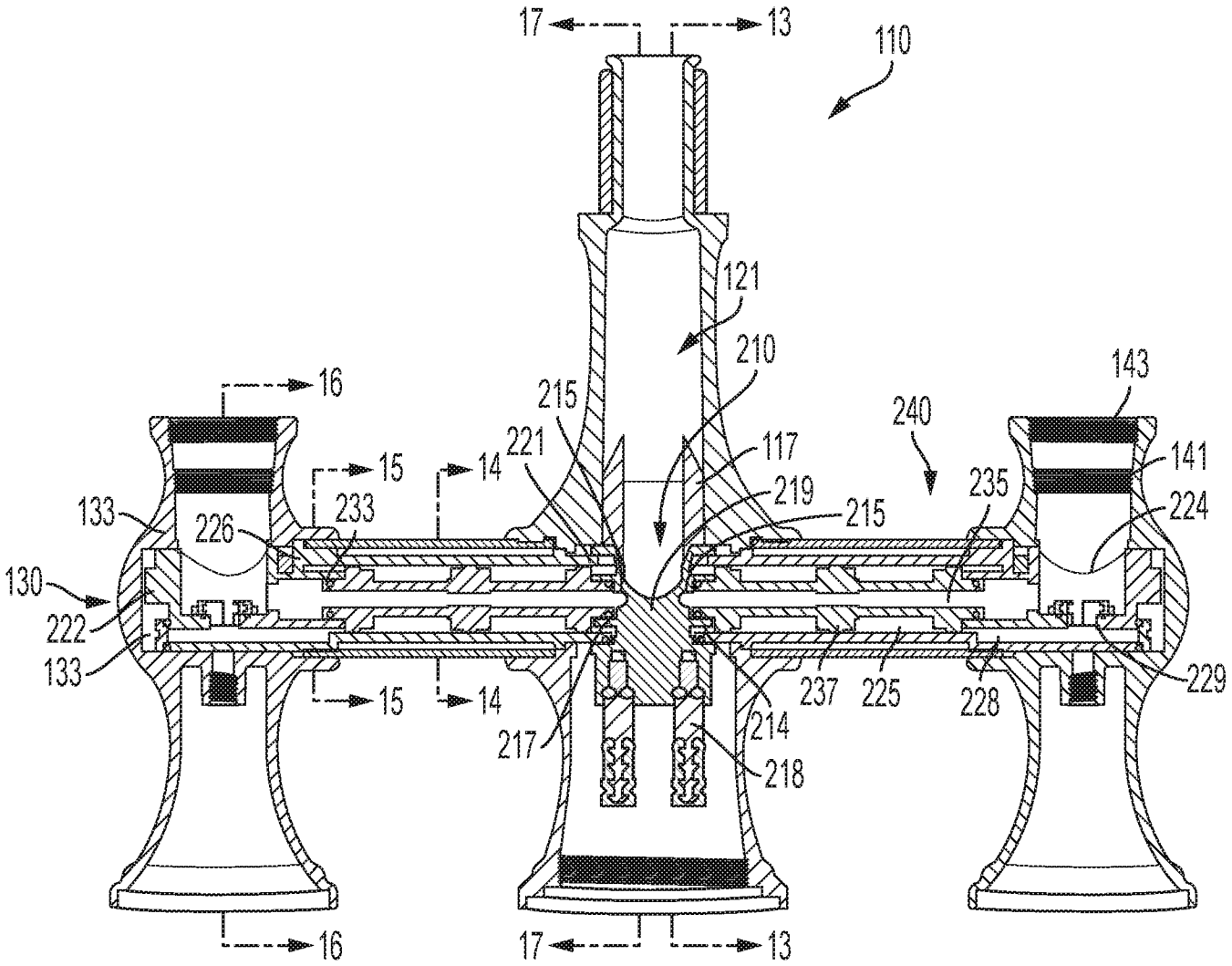
FIG. 11 is a cross-sectional view of a faucet housing assembly having only the connector assembly and waterway bodies of the flow assembly supported therein, according to an exemplary embodiment.

Referring to FIGS. 5 and 6, annular projections 125 of the sidewall 112 define openings 122 (e.g., side openings) via which side assemblies 240 of the flow assembly 200 are operably coupled to the connector assembly 210, which is supported within the chamber 121 of the center body 110 (see FIG. 11). Securement structures (e.g. grooves 127) are optionally provided along an inner surface of the sidewall 112 adjacent each opening 122. Each securement structure is configured to engage a corresponding securement element (e.g. threading 151) provided along an exterior of an attachment housing defined by each bridge 150 of the housing assembly 100 (see FIG. 3) to assist in interconnecting the center body 110 with an associated side body 130. In embodiments in which the exteriors of the side assemblies 240 define aesthetically acceptable designs and configurations, and each side assembly 240 secures an associated side body 130 to the center body 110, the bridges 150 may optionally be omitted from the housing assembly 100.

Although in the embodiments of faucet 10 illustrated in the FIGURES the first opening 122 in the sidewall 112 is shown as located diametrically opposite the second opening 122, the location and/or orientation of the first opening 122 relative to the second opening 122 and/or relative to the sidewall 112 of the center body 110 may be configured differently. The number and/or size of the openings 122 may also vary depending on the specific selection, configuration and arrangement of the components of the side assemblies 240 and/or connector assembly 210 that may affect the manner in which the side assemblies 240 are operably connected to the connector assembly 210.

Figure 8:
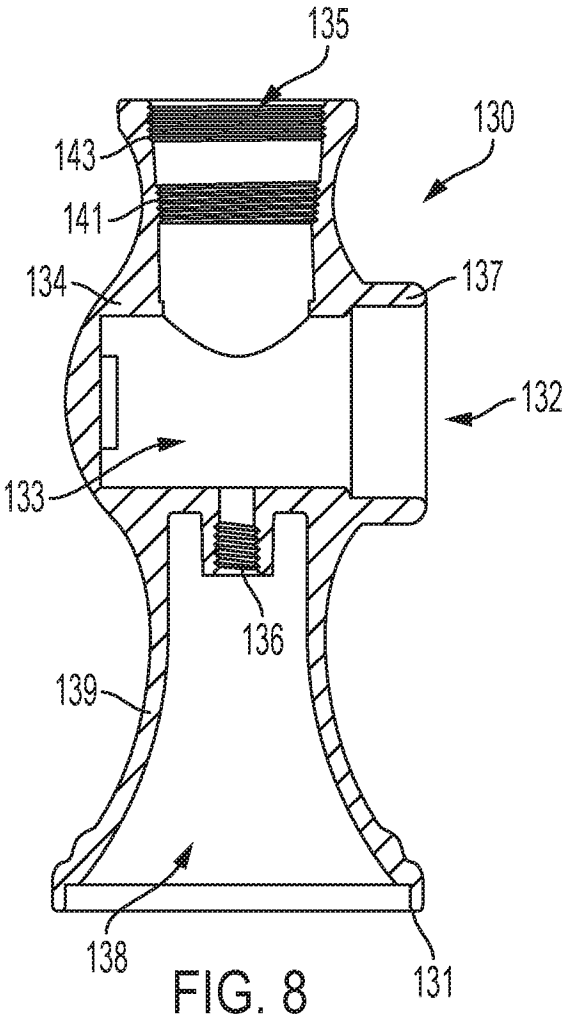
FIG. 8 is a cross-sectional view of the side post of FIG. 7.
Figure 7:
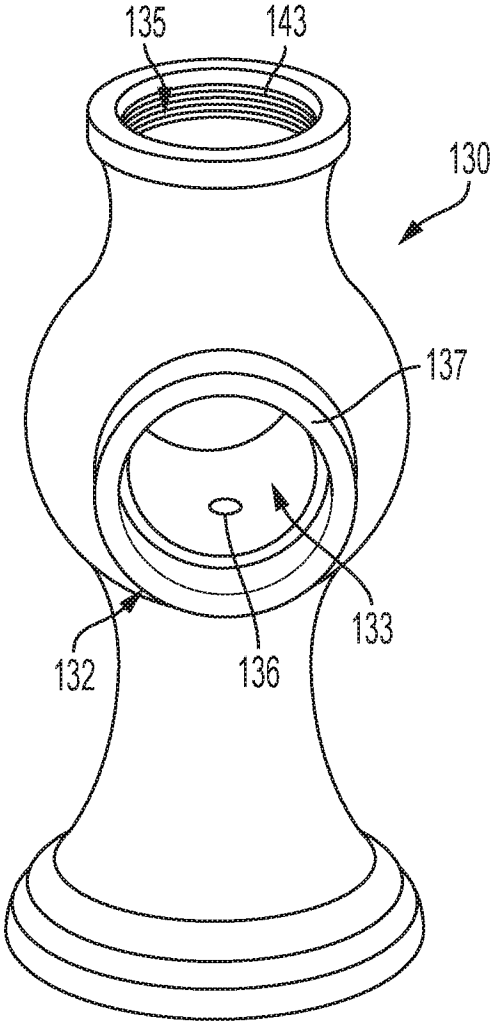
FIG. 7 is a perspective view of a side post, according to an exemplary embodiment.

Referring to FIGS. 7 and 8, the side bodies 130 each define a bore 133 or other chamber that is accessible via an opening 132 in the sidewall 134 of each side body 130. The illustrated opening 132 is defined by an annular projection 137 of the sidewall 134. The bore 133 and the opening 132 are sized such that a portion of a side assembly 240 may extend though the opening 132 and be supported within the bore 133 of the side body 130, such as by the annular projection 137 (see FIG. 11). The bore 133 of the side body 130 is also accessible via an upper opening 135 defined in an upper portion of the side body 130. The upper opening 135 is configured to allow a valve 260 to be inserted into the bore 133. The upper opening 135 is also configured to support an associated handle assembly 280 that is operably connected to the valve 260. As shown in FIG. 8, securement structures (e.g. grooves 141, 143) configured to engage corresponding securement elements of an associated valve 260 and/or an associated handle assembly 280 are optionally provided along an inner surface of the sidewall 134 adjacent the upper opening 135 (see FIG. 12).

Also shown in FIGS. 7 and 8, the side body 130 may optionally also include an attachment opening 136 extending through a lower wall surface that defines a bottom of the bore 133 and that defines a passageway between the bore 133 and a lower opening 138 of each side body 130. The lower opening 138 may optionally be defined within a base portion 139 of the side body 130. The attachment opening 136 may be configured to receive (or support) an attachment element (e.g. a threaded rod) that may be used to facilitate the attachment of the side body 130 to the support structure. The passageway defined by the attachment opening 136 is however not configured or intended to be used to directly fluidly couple the bore 133 to either of the hot or cold water supplies. As shown in FIG. 2, upon the installation of the faucet 10, the passageway between the lower opening 138 of the side body 130 and the bore 133 is fluidly isolated from each of the hot and cold water supplies. In other embodiments, the threaded opening 136 may be used to facilitate the assembly of a valve 260, handles assembly 280 and/or side assembly 240 to an associated side body 130.

The flow assembly 200 of the faucet 10 includes a connector assembly 210, a pair of (e.g., first and second, hot and cold, etc.) side assemblies 240, and a pair of (e.g., first and second, hot and cold, etc.) handle assemblies 280. The first side assembly 240 is operably connected to the connector assembly 210 to selectively fluidly couple the first hot water inlet 211 of the connector assembly 210 to an outlet 213 of the connector assembly 210, where the selective fluid couple is responsive to movement (e.g., rotation or other actuation) of the first handle assembly 280 relative to the first side body 130. The second side assembly 240 is operably connected to the connector assembly 210 to selectively fluidly couple the first cold water inlet 212 of the connector assembly 210 to an outlet of the connector assembly 210, where the selective fluid couple is responsive to movement of the second handle assembly 280 relative to the second side body 130. A variety of connector assembly 210, side assembly 240, and/or handle assembly 280 structures and configurations may define the flow assembly 200.

Figure 9:
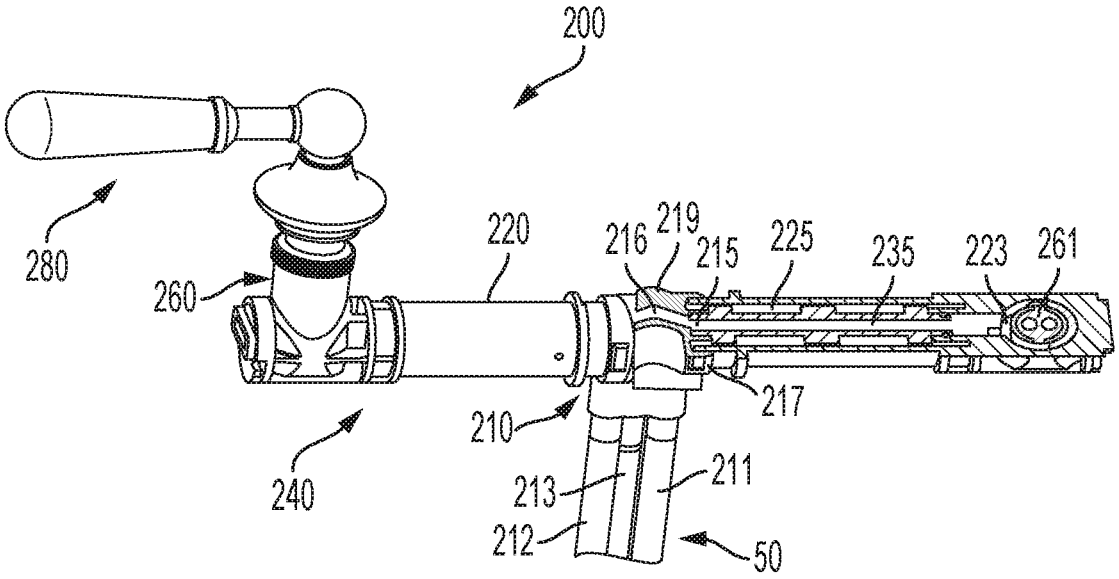
FIG. 9 is a top perspective view of an assembled flow assembly, in which right-half portion illustrates a cross-sectional view of the flow assembly, according to an exemplary embodiment.
Figure 10:
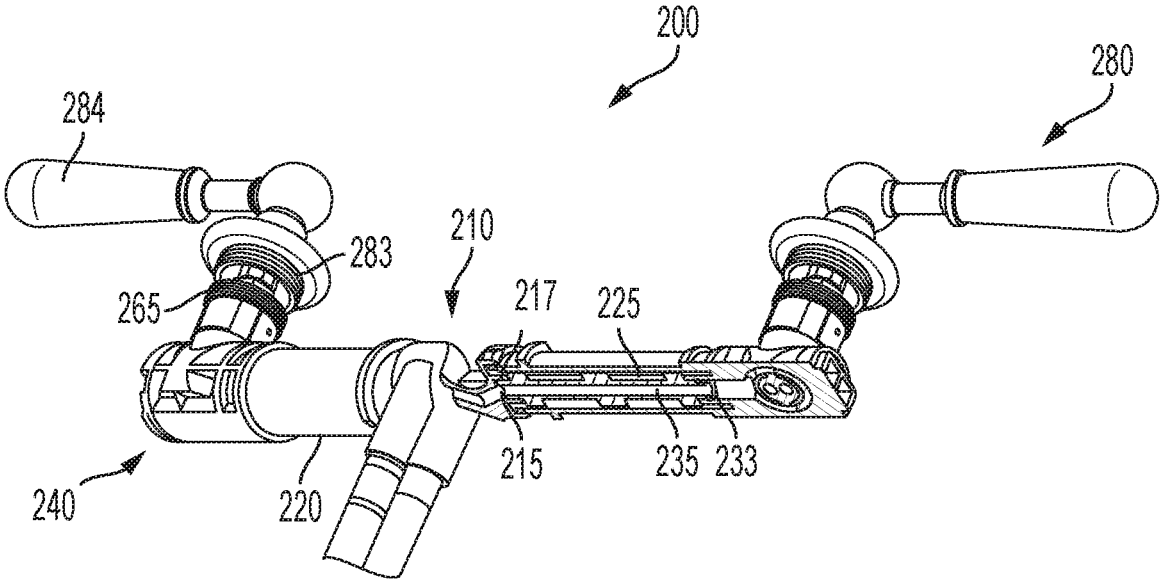
FIG. 10 is a bottom perspective view of an assembled flow assembly, in which right-half portion illustrates a cross-sectional view of the flow assembly, according to an exemplary embodiment.

A flow assembly 200 according to an exemplary embodiment is shown in FIGS. 9 and 10. The connector assembly 210 of the flow assembly 200 of FIGS. 9 and 10 includes a center waterway body, such as connector body 219, that defines the first hot water inlet 211, the first cold water inlet 212 and the outlet 213. The first hot water inlet 211 and first cold water inlet 212 are each configured to be fluidly coupled to an external hot water supply source and cold water supply source, respectively, via fluid tubing 50 (see FIG. 12). The outlet 213 is configured to be fluidly coupled to the spout 20 via the upper opening 119 of the center body 110. As discussed above, the outlet 213 may be fluidly coupled to the spout 20 according to a variety of arrangements. As shown in FIG. 11, each of the first hot water inlet 211, first cold water inlet 212 and outlet 213 is optionally connected to the fluid tubing 50 via connector structures (e.g., adaptors 218).

As shown in FIG. 11, the connector body 219 also defines a pair of outlet openings 214, (a hot water outlet, a cold water outlet) and a pair of second inlets 215 (second hot water inlet, second cold water inlet). The pair of outlet openings 214 and the pair of second inlets 215 fluidly couple each of the side assemblies 240 to the connector body 219. The connector body 219 optionally includes and/or defines a connecting structures (e.g. sealing sidewalls 217) configured to sealingly connect the first side assembly 240 to the connector body 219 about each of the hot water outlet 214 and the second hot water inlet 215, and to sealingly connect the second side assembly 240 to the connector body 219 about each of the cold water outlet 214 and the second cold water inlet 215.

Hot water from the first hot water inlet 211 flows through the hot water outlet 214, into the first side assembly 240, and selectively into a mixing chamber 216 of the connector body 219 via the second hot water inlet 215. Cold water from the first cold water inlet 212 flows through the cold water outlet 214, into the second side assembly 240, and selectively into the mixing chamber 216 via the second cold water inlet 215. The mixing chamber 216 is fluidly coupled to the outlet 213, allowing hot water and/or cold water within the mixing chamber 216 to be dispensed through the spout 20.

The pair of side assemblies 240 of the illustrated flow assembly 200 of FIGS. 9 and 10 includes first and second waterway bodies 220 (e.g., hot water waterway body and cold water waterway body) and first and second valves 260 (e.g., hot water valve, cold water valve). As shown in FIGS. 9 and 10, each waterway body 220 extends between an open (e.g., first) end 221, and a closed (e.g., second) end 222. As shown in FIG. 11, an attachment wall 226 supporting an attachment post extends radially inwardly from an interior surface of each waterway body 220 located between the open end 221 and the closed end 222. A hollow body 230 is sealingly attached to and extends from the attachment post of attachment wall 226 to the open end 221 of the waterway body 220. One or more support elements 237 configured to support the hollow body 230 within the interior of the waterway body 220 optionally extend radially outwards from an exterior surface of the hollow body 230 and/or radially inwards from the interior surface of the waterway body 220.

The fluid passage of each waterway body 220 extending between the open end 221 and the attachment wall 226 and between the interior surface of the waterway body 220 and the exterior surface of the hollow body 230 defines an inlet flow path 225 (e.g., a first hot water passageway, a first cold water passageway) of the associated waterway body 220. The fluid passage defined by the hollow body 230 of each associated waterway body 220 defines an associated outlet flow path 235 (e.g., a second hot water passageway, a second cold water passageway).

A chamber 223 accessible via an opening 224 in the waterway body 220 is defined between the attachment wall 226 and the closed end 222 of each waterway body 220. As shown in FIG. 11, the inlet flow path 225 is fluidly connected to the chamber 223 via a channel 228 extending between a first opening 227 defined through the attachment wall 226 and a second opening 229 defined through a surface of the waterway body 220 that defines a lower surface of the chamber 223. An outlet opening 233 fluidly couples the chamber 223 to the passageway of the hollow body 230 that defines the outlet flow path 235 of each associated waterway body 220.

Figure 12:
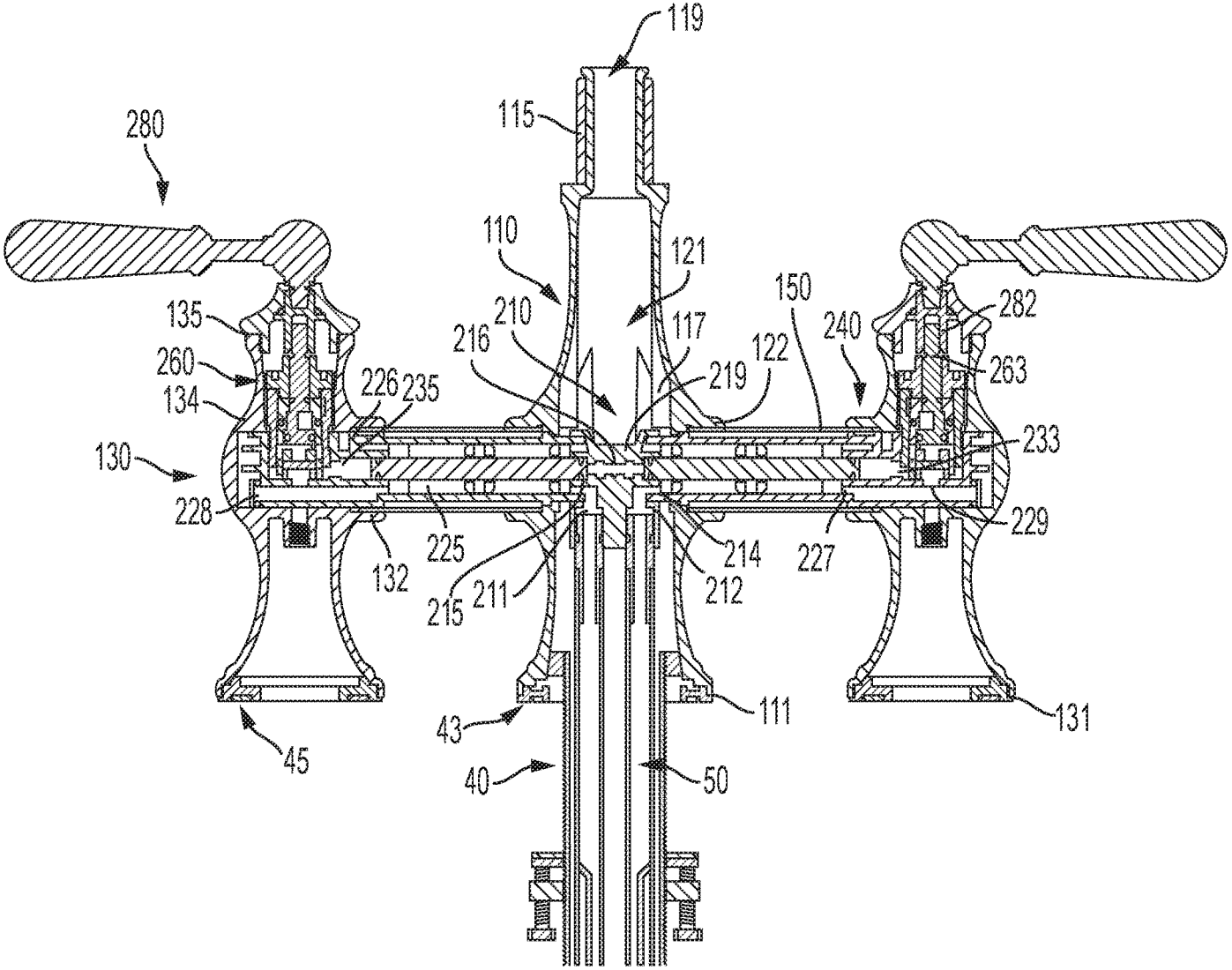
FIG. 12 is a cross-sectional view of the assembled faucet shown in FIG. 2.

As shown in FIG. 12, a valve 260 is disposed within the chamber 223 of each waterway body 220. A stem 263 of the valve 260 is operably connected to an actuating element 282 of an associated handle assembly 280. Upon movement of the handle 284 of the handle assembly 280, the actuating element 282 effectuates a movement (e.g., rotation) of the valve body 261 relative to the associated side body 130. The movement of the valve body 261 selectively couples the inlet flow path 225 of the associated waterway body 220 with the outlet flow path 235.

As shown in FIG. 11, upon assembly of the faucet 10, the open end 221 of each waterway body 220 is supported within the center body 110. The open end 221 of the hot water waterway body 220 is configured to be fluidly coupled to the connector body 219 (e.g., via a first sealing sidewall 217) to fluidly couple the hot water outlet 214 to the inlet hot water flow path 225, and to fluidly couple the outlet hot water flow path 235 to the second hot water inlet 215. The open end 221 of the cold water waterway body 220 is configured to be fluidly coupled to the connector body 219 (e.g., via a second sealing sidewall 217) to fluidly couple the cold water outlet 214 to the inlet cold water flow path 225, and to fluidly couple the outlet cold water flow path 235 to the second cold water inlet 215.

The closed end 222 of each waterway body 220 is supported within one of the two side bodies 130 by the annular projection 137 of the associated side body 130. The waterway body 220 is positioned within the bore 133 of the associated side body 130 such that the opening 224 of the waterway body 220 is aligned with the upper opening 135 of the associated side body 130. Although the side assemblies 240 and side bodies 130 are shown as extending/being located diametrically opposite to one another (e.g., relative to the center body 110), the orientation of the side assemblies 240 and/or the side bodies 130 relative to one another, or relative to the center body 110, may be varied as desired.

As shown in FIG. 12, upon the attachment of a waterway body 220 with the associated side body 130, a valve 260 is inserted through the upper opening 135 of the associated side body 130, and positioned within the chamber 223 of the waterway body 220. The valve 260 is optionally secured against vertical movement relative to the associated side body 130 via an engagement of a securement element (e.g. threading 265) provided about the exterior of the valve body 261 to a corresponding securement structure (e.g. grooves 141) of the associated side body 130. As also shown in FIG. 12, the actuating element 282 of a handle assembly 280 is inserted through the upper opening 135 of the associated side body 130 and operably engaged with the valve stem 263. A securement element (e.g. threading 283) provided by the handle assembly 280 is engaged with a corresponding securement structure (e.g. grooves 143) of the associated side body 130 to secure the handle assembly 280 relative to the associated side body 130.

As shown in FIG. 12, upon assembly of the side assemblies 240 within the side bodies 130 and center body 110 of the housing assembly 100, a portion of each waterway body 220 extends externally relative to, and between the exteriors of the associated side body 130 and center body 110. The length of this central, externally located portion of each waterway body 220 corresponds to a distance by which the associated side body 130 is laterally offset and separated from the center body 110.

The length of the central, externally located portions of the waterway bodies 220 and/or the offset distances between the side bodies 130 and center body 110 may be varied as desired, such as to achieve a desired faucet 10 footprint and/or design aesthetic. According to one or more embodiments, a distance by which a longitudinal axis of each side body 130 is offset from a longitudinal axis of the center body 110 may be approximately 4 inches.

Figure 14:
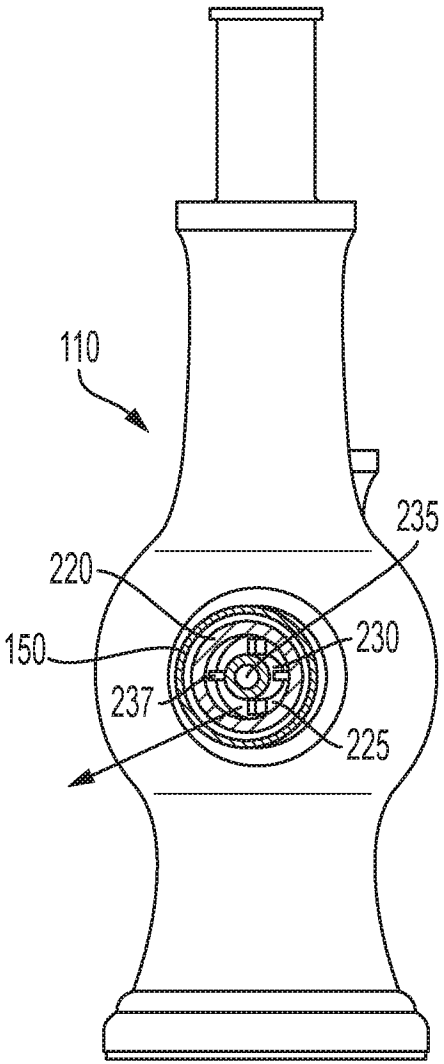
FIGS. 13-17 are cross-sectional views of the faucet shown in FIG. 11 taken along lines 13-13, 14-14, 15-15, 16-16, and 17-17.
Figure 13:
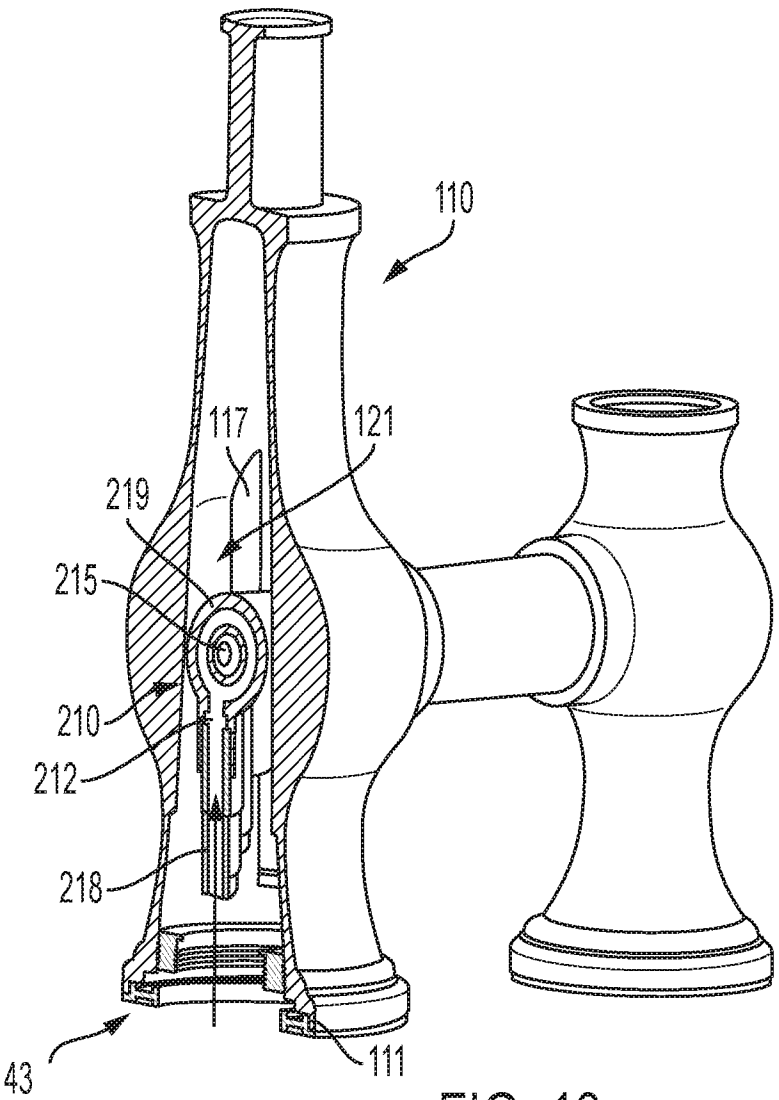
Figure 17:
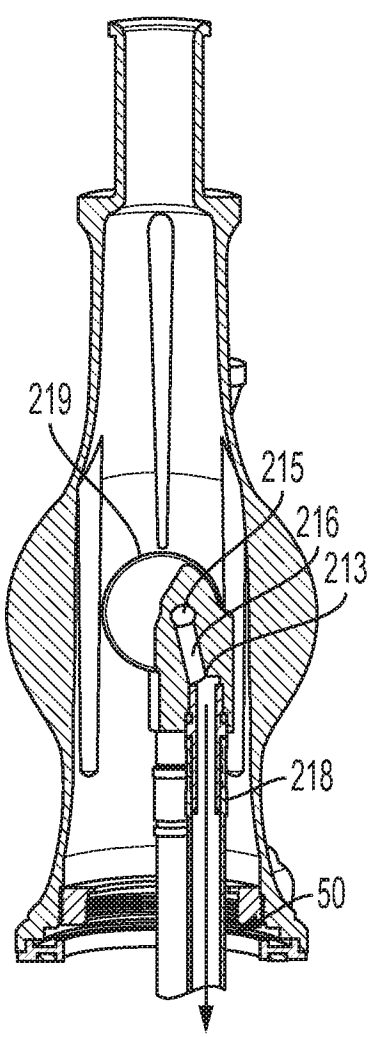
Figure 16:
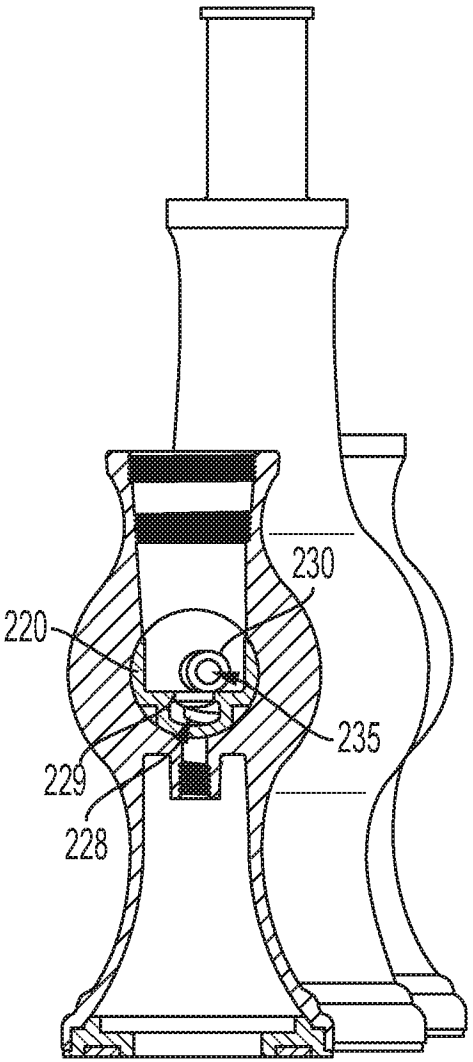
Figure 15:
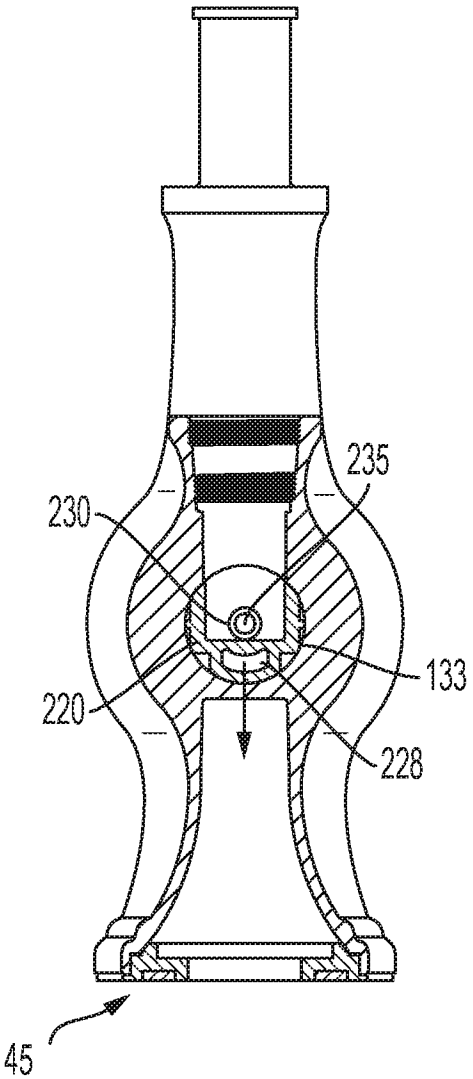

During operation of the faucet 10, the selective dispensing of hot, cold or a mixture of hot and cold water is effectuated in response to the movement (or other actuation) of the handle 284 associated with the hot or cold fluid supply from which it is desired that the faucet 10 deliver water from. For example, to effectuate dispensing of hot water through the faucet 10, a handle 284 operably connected to the hot water waterway body 220 is rotated (or otherwise moved) relative to the associated side body 130 to cause the actuating element 282 of the handle assembly 280 to engage and effectuate the rotation of an associated valve 260 relative to the associated side body 130. As shown in FIG. 13, in response to the movement of the handle 284, hot water from the hot water supply flows into the first hot water inlet 211 of the connector body 219. The hot water from the first hot water inlet 211 flows through the hot water outlet 214 of the connector body 219 and into the inlet hot water flow path 225 of the hot water waterway body 220, such as shown in FIG. 14. The hot water within the inlet hot water flow path 225 flows through the opening 227 of the attachment wall 226 and into the channel 228, as shown in FIG. 15. From the channel 228, the hot water flows through opening 229 and into the chamber 223. The fluid communication between the chamber 223 and the outlet hot water flow path established via the rotation of the hot water valve body 261 responsive to the movement of the handle 284 allows the hot water to flow from the chamber 223 into the outlet hot water flow path 235, as shown in FIG. 16. Hot water from the outlet hot water flow path 235 flows through the second hot water inlet 215 and into the mixing chamber 216, before flowing out through the outlet 213 as shown in FIG. 17. If the cold water handle 284 has also been rotated to fluidly couple the cold water supply source to the outlet 213, the hot water may mix with the cold water in the mixing chamber 216 prior to flowing through the outlet 213 and being dispensed through the spout 20.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the cleaning systems, dispensing systems, toilets, standalone systems, etc. as shown in the numerous exemplary embodiments of this application are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., dispenser, generator, container, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet comprising:

a center body having a sidewall extending about and defining an internal passageway and a support surface on an end of the sidewall, the center body having a cold water inlet in the internal passageway, a hot water inlet in the internal passageway, and an outlet;

a spout coupled to the center body and fluidly connected to the outlet;

a first side body offset from the center body in a first direction, the first side body having a sidewall extending about and defining a bore and a support surface;

a second side body offset from the center body in a second direction, the second side body having a sidewall extending about and defining a bore and a support surface;

a first valve located in the bore of the first side body and comprising a stem configured to be rotated relative to the first side body to control flow through the first side body;

a second valve located in the bore of the second side body;

a first bridge interconnecting the center body and the first side body, the first bridge including a first fluid passage, which fluidly connects the cold water inlet to an inlet of the first valve, and a second fluid passage, which fluidly connects an outlet of the first valve to the outlet of the center body; and a second bridge interconnecting the center body and the second side body, the second bridge including a first fluid passage, which fluidly connects the hot water inlet to an inlet of the second valve, and a second fluid passage, which fluidly connects an outlet of the second valve to the outlet of the center body.

2. The faucet of claim 1, wherein the support surfaces of each of the first side body, second side body and center body extend along parallel planes.

3. The faucet of claim 1, wherein the support surfaces of each of the center body, the first side body, and the second side body are coplanar.

4. The faucet of claim 1, wherein the support surface of at least one of the center body, the first side body, or the second side body is spaced apart and separated from at least one of the other support surfaces in a longitudinal direction of the center body.

5. The faucet of claim 4, wherein:

a first gasket is provided within an inner periphery defined by the support surface of the first side body, a second gasket is provided within an inner periphery defined by the support surface of the second side body, and a third gasket is provided within an inner periphery defined by the support surface of the center body;

the first gasket extends downwards relative to the support surface of the first side body by a first distance, the second gasket extends downwards relative to the support surface of the second side body by the first distance, and the third gasket extends downwards relative to the support surface of the center body by a second distance; and the first distance is less than the second distance.

6. The faucet of claim 1, wherein:

the first bridge comprises:

a first end extending through a first opening in the sidewall of the center body to connect the first end of the first bridge to the center body; and a second end extending through a second opening in the sidewall of the first side body to connect the second end of the first bridge to the first side body; and the second bridge comprises:

a first end extending through a third opening in the sidewall of the center body to connect the first end of the second bridge to the center body; and a second end extending through a fourth opening in the sidewall of the second side body to conned the second end of the second bridge to the second side body.

7. The faucet of claim 6, wherein the first opening and the third opening of the center body are located on opposite sides of the center body, such that the first bridge and second bridge extend outwardly away from the sidewall of the center body in opposite directions.

8. The faucet of claim 1, wherein each of the first bridge and the second bridge extends in a transverse direction relative to a longitudinal axis of the center body.

9. A faucet configured to be mounted on a planar support structure, the faucet comprising:

a center post having a sidewall defining an internal cavity;

a connector body disposed in the internal cavity and defining a cold water inlet, a hot water inlet, and an outlet;

a first side post coupled to an exterior surface of the sidewall and configured to abut the planar support structure when the faucet is mounted on the planar support structure, the first side post configured to house a first valve, which is configured to selectively fluidly couple an inlet cold water flow path, which is fluidly connected to the cold water inlet, with an outlet cold water flow path, which is fluidly connected to the outlet of the connector body; and a second side post coupled to the exterior surface of the sidewall and configured to abut the planar support structure when the faucet is mounted on the planar support structure, the second side post configured to house a second valve, which is configured to selectively fluidly couple an inlet hot water flow path, which is fluidly connected to the hot water inlet, with an outlet hot water flow path, which is fluidly connected to the outlet of the connector body.

10. The faucet of claim 9, wherein each side post has a longitudinal axis that is offset from a longitudinal axis of the center post by a distance of at least 4 inches.

11. The faucet of claim 9, further comprising:

a first fluid coupling connecting a cold water supply source to the cold water inlet; and a second fluid coupling connecting a hot water supply source to the hot water inlet, each of the first fluid coupling and the second fluid coupling extending through a portion of the internal cavity defined by the sidewall.

12. The faucet of claim 9, wherein:

each of the inlet cold water flow path and the outlet cold water flow path extends through each of a first opening in the sidewall and a second opening in the first side post that is spaced apart and longitudinally offset from the first opening in the sidewall such that a portion of each of the inlet cold water flow path and the outlet cold water flow path extends externally relative to each of the sidewall and the first side post; and each of the inlet hot water flow path and the outlet hot water flow path extends through each of a third opening in the sidewall and a fourth opening in the second side post that is spaced apart and longitudinally offset from the third opening in the sidewall such that a portion of each of the inlet hot water flow path and the outlet hot water flow path extends externally relative to each of the center post and the second side post.

13. The faucet of claim 12, further comprising:

a first bridge disposed between and interconnecting the first side post and the sidewall; and a second bridge disposed between and interconnecting the second side post and the sidewall.

14. The faucet of claim 13, wherein:

the first bridge includes a first attachment housing having an interior within which a body defining a portion of each of the inlet cold water flow path and the outlet cold water flow path is supported, the first attachment housing interconnecting the first bridge to the center post and the first side post;

the second bridge includes a second attachment housing having an interior within which a body defining a portion of each of the inlet hot water flow path and the outlet hot water flow path is supported, the second attachment housing interconnecting the second bridge to the center post and the second side post.

15. The faucet of claim 14, wherein:

a portion of the body supported within the first bridge extends within an interior of the first side post;

a portion of the body supported within the second bridge extends within an interior of the second side post; and lower portions of each of the sidewall defining the center post, the first side post, and the second side post define substantially coplanar or substantially parallel support surfaces.

16. The faucet of claim 15, further comprising the first valve and the second valve, wherein the first valve is positioned in a fifth opening defined by the portion of the body supported within the first bridge that extends within the interior of the first side post and the second valve is positioned in a sixth opening defined by the portion of the body supported within the second bridge that extends within the interior of the second side post.

17. A faucet configured to be supported on a planar support structure, the faucet comprising:

a center body extending along a longitudinal axis between a lower end defining a support surface and an upper portion, the support surface configured to abut the support structure;

a first side body extending along a longitudinal axis that is offset from the longitudinal axis of the center body, the first side body having a lower end defining a support surface that is configured to abut the planar support structure when the faucet is supported on the planar support structure;

a second side body extending along a longitudinal axis that is offset from the longitudinal axis of the center body, the second side body having a lower end defining a support surface that is configured to abut the planar support structure when the faucet is supported on the planar support structure;

a center waterway body disposed within the center body and comprising a first hot water inlet and a second hot water inlet, a hot water outlet fluidly coupled to the first hot water inlet, a first cold water inlet and a second cold water inlet, a cold water outlet fluidly coupled to the first cold water inlet, and an outlet fluidly coupled to the second hot water inlet and the second cold water inlet;

a first waterway body interconnecting the first side body and the center body, the first waterway body defining an inlet flow path, which fluidly connects the hot water outlet to an inlet of the first side body, and an outlet flow path, which fluidly connects an outlet of the first side body to the second hot water inlet; and a second waterway body interconnecting the second side body and the center body, the second waterway body defining an inlet flow path, which fluidly connects the cold water outlet to the inlet of the second side body, and an outlet flow path, which fluidly connects an outlet of the second side body to the second cold water inlet.

18. The faucet of claim 17, further comprising:

a first valve located within a bore of the first side body, wherein the first valve fluidly connects/disconnects the inlet and the outlet of the first side body; and a second valve located within a bore of the second side body, wherein the second valve fluidly connects/disconnects the inlet and the outlet of the second side body, wherein the support surface of each of the first side body and the second side body is spaced apart laterally from the support surface of the center body.

19. The faucet of claim 18, further comprising:

a first bridge housing extending between and interconnecting the center body and the first side body, wherein the first waterway body is disposed within the first bridge housing; and a second bridge housing extending between and interconnecting the center body and the second side body, wherein the second waterway body is disposed within the second bridge housing.

20. The faucet of claim 19, wherein:

a portion of the first waterway body is supported within the first side body; and a portion of the second waterway body is supported within the second side body.

* * * * *